United States Patent [19]

Kastlunger

[11] Patent Number: 4,869,217

[45] Date of Patent: Sep. 26, 1989

[54] INTERNAL COMBUSTION ENGINE HAVING LIGHT METAL HOUSING PARTS

[75] Inventor: Siegfried Kastlunger, Schaerding, Austria

[73] Assignee: Motorenfabrik Hatz GmbH & Co. KG, Bundesrepublik, Fed. Rep. of Germany

[21] Appl. No.: 263,644

[22] Filed: Oct. 27, 1988

[30] Foreign Application Priority Data

Feb. 13, 1988 [DE] Fed. Rep. of Germany ..... 3804517

[51] Int. Cl.[4] ..... F02F 7/00

[52] U.S. Cl. ..... 123/195 R; 123/193 CH

[58] Field of Search ..... 123/195 R, 193 CH

[56] References Cited

U.S. PATENT DOCUMENTS

| | | | |
|---|---|---|---|
| 3,046,952 | 7/1962 | Dolza | 123/195 R |
| 3,046,953 | 7/1962 | Dolza | 123/195 R |
| 3,059,623 | 10/1962 | Booth et al. | 123/195 R |
| 4,745,892 | 5/1988 | Ruf et al. | 123/195 R |

FOREIGN PATENT DOCUMENTS

| | | |
|---|---|---|
| 444991 | 5/1927 | Fed. Rep. of Germany . |
| 3122533 | 4/1982 | Fed. Rep. of Germany . |

*Primary Examiner*—E. Rollins Cross

*Attorney, Agent, or Firm*—Flynn, Thiel, Boutell & Tanis

[57] ABSTRACT

The present invention provides for an internal combuston engine having housing parts such as a cylinder, cylinder head and crankcase formed of a light metal. A plurality of tightening screws are provided for securing the above-mentioned parts so as to form an engine block, the screws having threaded ends which are received in the heads of steel tie rods which are integral with the crankcase and which extend substantially parallel to the cylinder axis. When the engine is in use, the tightening of the light metal housing parts by way of the steel tie rods, prevents undesired deformation of the crankcase.

3 Claims, 1 Drawing Sheet

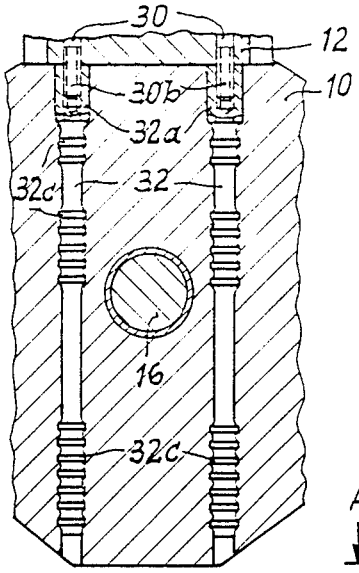
Fig. 3
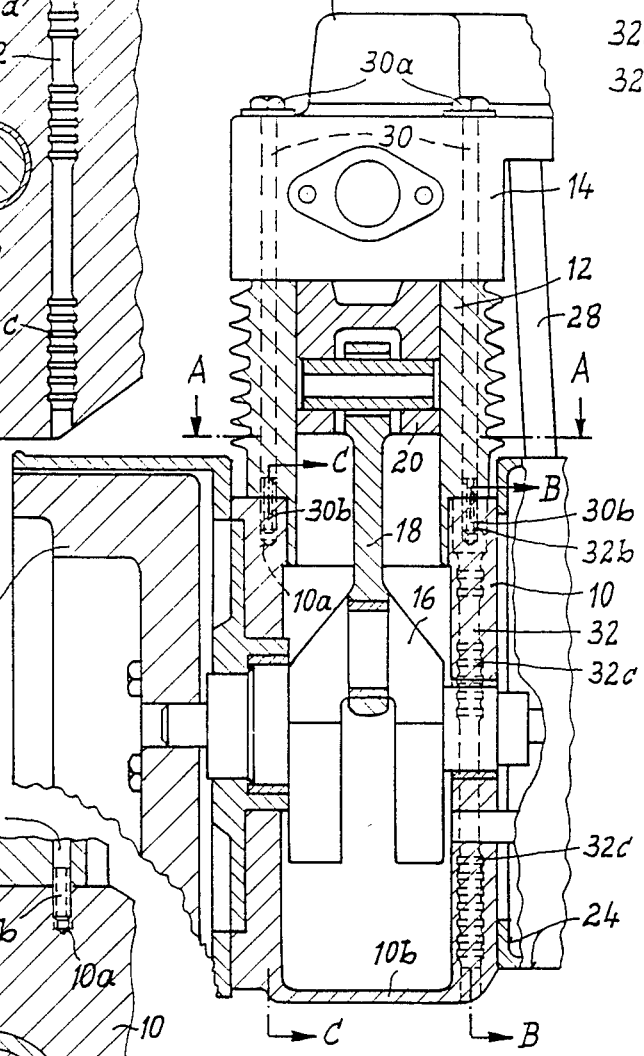
Fig. 1
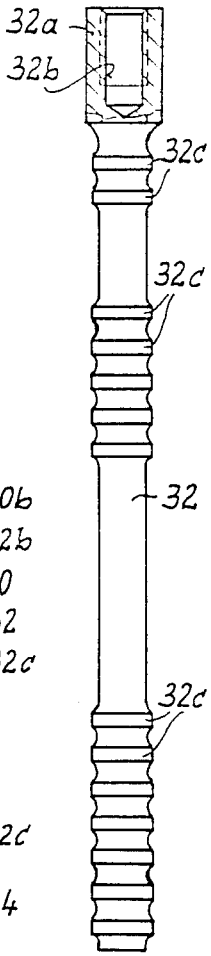
Fig. 5
Fig. 4
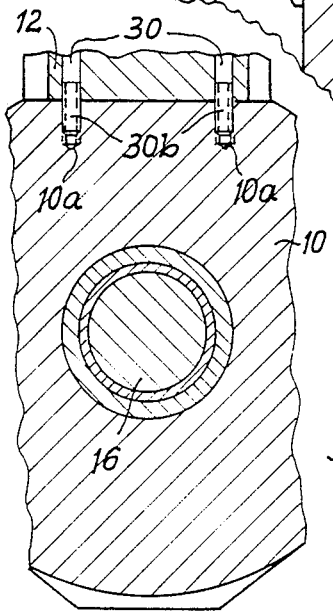
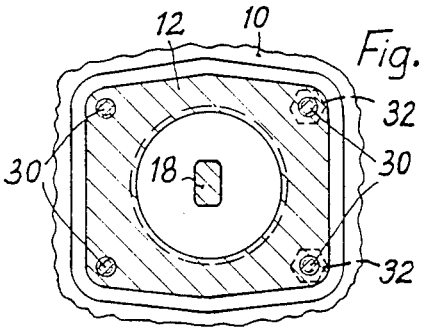
Fig. 2
Fig. 6
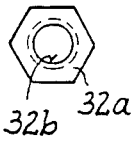

INTERNAL COMBUSTION ENGINE HAVING LIGHT METAL HOUSING PARTS

FIELD OF THE INVENTION

The present invention relates to an internal combustion engine having housing parts such as a cylinder, cylinder head and crankcase, which are made of light metal, wherein a plurality of tightening screws are provided for securing the parts into a single engine block, which screws are disposed substantially parallel to the cylinder axis and pass through the cylinder head and cylinder, the head of the screws being seated on the cylinder head, and their threaded end being received in tapped holes in the crankcase.

BACKGROUND OF THE INVENTION

The present invention seeks to substantially reduce the forces acting on the crankcase during engine operation. These forces (tension and/or pressure forces) are caused by the considerable ignition forces in the cylinder and inertia forces of the crankshaft. By relieving the forces acting on the crankcase, it is intended to advantageously reduce the required thickness of the walls of this housing part and also to enable the walls to accommodate openings or bores in addition to the bearing openings for the crankshaft, for example bearing points for the elements disposed in the crankcase for balancing inertia forces of the moving engine parts.

According to the present invention there is provided an internal combustion engine having housing parts forming a cylinder, cylinder head and crankcase, which are made of light metal, wherein a plurality of tightening screws are provided for securing the parts into a single engine block, which screws are disposed substantially parallel to the cylinder axis and pass through the cylinder head and cylinder, and wherein the heads of the screws are seated on the cylinder head, and their threaded ends engage in tapped holes in the crankcase, and further comprising at least two steel tie rods, each of which has a head at one end, which head has a threaded opening, and which tie rods are cast with the crankcase so as to be integral therewith and in such a way that a tie rod is provided on each side of a bearing opening for the crankshaft in the crankcase, which tie rod extends substantially through the entire crankcase, has its longitudinal direction substantially parallel to the cylinder axis, and its threaded opening serving to accommodate the threaded portion of a tightening screw.

The tie rod may readily be dimensioned in such a way that it absorbs the above-mentioned forces acting on the crankcase to a large extent, and hence greatly reduces the forces acting on the housing.

According to an advantageous feature of the present invention, the head of the tie rod is in the form of a hexagon, so as to prevent the tie rod from rotating during casting and tightening.

According to yet another advantageous feature of the present invention, a plurality of circumferential ribs are formed along the tie rod and serve to hold it in the crankcase and to transfer forces, which develop during engine operation, from the crankcase to the tie rod. Advantageously, the circumferential ribs are distributed in the longitudinal direction of the tie rod in such a way that the number thereof is related to the magnitude of the forces associated with the part of the crankcase which surrounds the ribs.

BRIEF DESCRIPTION OF THE DRAWINGS

The invention is described further hereinafter, byway of example only, with reference to the accompanying drawings, in which:

FIG. 1 is a longitudinal section through one embodiment of an engine in accordance with the present invention;

FIG. 2 is a cross-section taken along the line A—A of FIG. 1;

FIGS. 3 and 4 are longitudinal sections along the lines B—B and C—C, respectively, of FIG. 1; and FIGS. 5 and 6 show a plan view and an end view of a tie rod of FIG. 1 on a larger scale.

DETAILED DESCRIPTION

FIG. 1 is a longitudinal section through a perpendicular, single-cylinder internal combustion engine, whose housing parts, namely a crankcase 10, a cylinder 12 and a cylinder head 14, which are made of light metal, are secured to form a single engine block. The engine block is fastened, that is screwed, in a known way on to a foundation, with the base 10*b* of the crankcase 10 being seated on the foundation (not shown). The crankshaft 16 is mounted in the crankcase 10 and is connected in a known way to a connecting rod 18 and a piston 20. A flywheel 22 is fastened to one end of the crankshaft 16, whereas the other end of the crankshaft drives in a known way the control elements which control the rocker arm provided to actuate the inlet and outlet valves. These control elements are surrounded by a housing 24, which is fastened to the crankcase 10, and they engage with the rocker arms disposed beneath a lid 26 by way of push rods guided inside a cover 28.

In order to tighten the light metal housing 10,12,14 into a single block, four long, steel tightening screws 30 are used which pass through the cylinder head 14 and cylinder 12. The heads 30*a* of the screws are seated on the upper outer face of the cylinder head, and their threaded ends 30*b* engage in the crankcase 10. The arrangement is designed such that the threaded ends 30*b* of the two tightening screws 30, which are located on the flywheel side of the crankcase, engage directly in a conventional manner in threaded openings 10*a* in the crankcase 10, as shown in FIG. 4. It would also be possible to use threaded steel bushings, in which the threaded ends of the tightening screws engage, in order to avoid damage to the thread in the crankcase when tightening housing parts made of particularly soft light metal materials. For reasons of simplicity, such an arrangement has not been shown in the illustrated embodiment.

On the side of the crankcase 10 remote from the flywheel 22, two steel tie rods 32 (FIGS. 5 and 6) are disposed, each of which has a hexagonal head 32*a* with an internal thread 32*b*, and is cast with the crankcase 10 so as to be integral therewith. A tie rod 32 is located on either side of the crankshaft 16, extends across the entire crankcase and runs parallel to the cylinder axis in its longitudinal direction, as can be seen in FIG. 3. The threaded end 30*b* of an associated tightening screw 30 engages in the threaded head 32*b* of each tie rod 32.

The tie rods 32 are provided with a plurality of circumferential ribs 32*c* which, together with the hexagonal head 32*a*, serve to hold the tie rod in the crankcase such that it cannot rotate. The circumferential ribs 32*c* are distributed in the longitudinal direction of the tie rods 32 in such a way that the number thereof is adapted in relation to the magnitude of the forces associated with the part of the crankcase which surrounds the ribs.

The method of tightening the light metal housing parts by means of the steel tie rod, as described, has very great advantages. Firstly, deformation (distortion) of the crankcase, and particularly of the bearing bores provided therein, is reliably prevented, notwithstanding the weakness of the housing walls. When the engine is operating, the circumferential ribs 32*c* of the tie rods 32 absorb unwanted, damaging forces and ensure that they are directly conveyed to the elongate tie rod 32, which in turn conveys these forces by way of the base 10*b* of the crankcase 10 to the engine foundation. These damaging forces arise during operation and comprise tension and/or pressure forces which result mainly from the ignition forces in the cylinder and from the inertia forces of the moving engine parts, in particular the crankshaft.

Finally, it should be mentioned that, given a particular crankcase design, all four tightening screws could be adapted to engage in tie rods. In the case of multi-cylinder internal combustion engines, a plurality of pairs of tightening screws and bolts are, of course, provided.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An internal combustion engine having housing parts forming a cylinder, cylinder head and crankcase, which are made of light metal, wherein a plurality of tightening screws are provided for securing said parts into a single engine block, which screws are disposed substantially parallel to the cylinder axis and pass through the cylinder head and cylinder, and wherein the heads of the screws are seated on the cylinder head, and their threaded ends engage in tapped holes in the crankcase, and further comprising at least two steel tie rods, each of which has a head at one end, which head has a threaded opening, and which tie rods are cast with the crankcase so as to be integral therewith and in such a way that a tie rod is provided on each side of a bearing opening for the crankshaft in the crankcase, which tie rod extends substantially through the entire crankcase, has its longitudinal directions substantially parallel to the cylinder axis, and its threaded opening serving to accommodate the threaded portion of a tightening screw.

2. An internal combustion engine as claimed in claim 1, wherein a plurality of circumferential ribs are formed along the tie rod so as to hold it in the crankcase and to transfer forces arising, during operation of the engine, from the crankcase to the tie rod.

3. An internal combustion engine as claimed in claim 2, wherein the circumferential ribs on the tie rod are distributed in a longitudinal direction in such a way that the number thereof is adapted in relation to the magnitude of the forces associated with the part of the crankcase which surrounds them.

* * * * *